US010315838B1

(12) United States Patent
Bishara

(10) Patent No.: US 10,315,838 B1
(45) Date of Patent: Jun. 11, 2019

(54) MOTOR VEHICLE FLUID MIXING AND DISPENSING CONTAINER

(71) Applicant: Anan Bishara, Brooklyn, NY (US)

(72) Inventor: Anan Bishara, Brooklyn, NY (US)

( * ) Notice: Subject to any disclaimer, the term of this patent is extended or adjusted under 35 U.S.C. 154(b) by 0 days.

(21) Appl. No.: 15/978,325

(22) Filed: May 14, 2018

(51) Int. Cl.
*B65D 85/816* (2006.01)
*B65D 47/06* (2006.01)

(52) U.S. Cl.
CPC ..... *B65D 85/816* (2013.01); *B65D 47/06* (2013.01)

(58) Field of Classification Search
CPC ..... B65D 85/816; B65D 47/06
USPC ..... 222/157, 424.5–457, 145.5, 158
See application file for complete search history.

(56) References Cited

U.S. PATENT DOCUMENTS 3,974,942 A 8/1976 Gray et al.
4,415,085 A * 11/1983 Clarke ..... A61J 1/05 206/526
4,974,732 A 12/1990 Sullivan et al.
5,330,081 A * 7/1994 Davenport ..... B65D 1/323 222/207
5,350,240 A 9/1994 Billman et al.
5,375,742 A * 12/1994 Mowry ..... B01F 13/002 222/131
5,447,245 A * 9/1995 Merhar ..... B65D 1/04 206/221
5,662,249 A * 9/1997 Grosse ..... B65D 47/147 141/319
6,082,591 A * 7/2000 Healey ..... B65D 1/023 222/158
6,773,622 B1 * 8/2004 Andrews ..... C09K 3/18 116/13
7,565,988 B2 * 7/2009 Foster ..... B05B 11/0056 222/129
7,926,682 B2 * 4/2011 Nelson ..... B01F 15/0205 141/330
8,348,098 B2 * 1/2013 Bruckner ..... B05B 11/0078 222/136
8,657,162 B2 * 2/2014 Kelly ..... B01F 13/002 222/158
9,586,727 B2 * 3/2017 Nathan ..... B65D 75/5811
9,650,018 B2 5/2017 Carroll
9,828,143 B2 11/2017 Nathan
2002/0076471 A1 6/2002 Olsson
(Continued)

*Primary Examiner* — Patrick M. Buechner
*Assistant Examiner* — Michael J. Melaragno
(74) *Attorney, Agent, or Firm* — Goldstein Law Offices, P.C.

(57) ABSTRACT

A fluid container for transporting, diluting, and dispensing a motor vehicle fluid, comprising an outer wall and a fluid chamber disposed within the outer wall adapted to hold liquids. The fluid container contains an additive concentrate stored within the fluid chamber which is adapted to be mixed with water to produce the motor vehicle fluid. The fluid container further has a selectively sealable opening which facilitates the delivery of water into the fluid chamber for mixing with the additive concentrate, and the dispensing of the resultant motor vehicle fluid. The outer wall has a transparent portion providing visibility into the fluid chamber and a calibrated dilution scale which allows a user to control the freezing point of the motor vehicle fluid by precisely diluting the motor vehicle fluid according to a plurality of dilution markers each representing a dilution level.

15 Claims, 5 Drawing Sheets

(56) References Cited

U.S. PATENT DOCUMENTS

| | | | | |
|---|---|---|---|---|
| 2003/0000961 | A1* | 1/2003 | Klima | B05B 11/0056 222/83.5 |
| 2005/0241976 | A1 | 11/2005 | Britto et al. | |
| 2006/0144244 | A1 | 7/2006 | Girard et al. | |
| 2006/0247143 | A1 | 11/2006 | Gallagher et al. | |
| 2007/0114245 | A1* | 5/2007 | Trent, Jr. | B65D 25/20 222/158 |
| 2008/0035671 | A1* | 2/2008 | Foster | B05B 11/0056 222/129 |
| 2008/0121655 | A1* | 5/2008 | Schultz | B05B 11/0081 222/129 |
| 2009/0152296 | A1* | 6/2009 | May | B05C 17/00553 222/129 |
| 2011/0174837 | A1* | 7/2011 | Nelson | B01F 15/0205 222/129 |
| 2011/0204086 | A1* | 8/2011 | Karam | B67D 7/08 222/25 |
| 2014/0175124 | A1* | 6/2014 | Nathan | B65D 75/5811 222/107 |
| 2014/0250838 | A1* | 9/2014 | Nathan | B65D 75/5811 53/455 |
| 2015/0292371 | A1* | 10/2015 | Barnes | F01M 11/04 123/196 A |
| 2015/0292674 | A1* | 10/2015 | Brett | F01M 11/04 220/562 |
| 2017/0120876 | A1* | 5/2017 | Busiello | B60S 1/50 |
| 2017/0259984 | A1* | 9/2017 | Cox | B65D 75/008 |
| 2018/0044068 | A1 | 2/2018 | Nathan | |
| 2018/0079574 | A1* | 3/2018 | Ishihara | B65D 75/008 |
| 2019/0039576 | A1* | 2/2019 | Ansaldi | B60S 1/481 |

* cited by examiner

MOTOR VEHICLE FLUID MIXING AND DISPENSING CONTAINER

TECHNICAL FIELD

The present disclosure relates generally to a container for a motor vehicle fluid. More particularly, the present disclosure relates to a fluid container for transporting and diluting a concentrated motor vehicle fluid and dispensing the resulting diluted motor vehicle fluid.

BACKGROUND

Windshield washer fluid is a vital motor vehicle fluid which is sold worldwide in vast quantities. The majority of windshield washer fluid is sold in a ready to use form popular with consumers for its convenience, often in containers holding 1 gallon of fluid. However, ready to use windshield washer fluid is heavy, and its transportation consumes significant resources, while the storage of windshield washer fluid containers requires large amounts of space. Furthermore, windshield washer fluid is typically sold in various formulas at different price points, with each formula having a different anti-freeze content and freezing point, requiring manufacturers and merchants to ship and store multiple formulas of windshield washer fluid to suit different consumer needs, seasons, and climates.

Concentrated washer fluid and solid washer fluid tablets alleviate some of the transportation and storage costs associated with ready to use washer fluid, at the expense of consumer convenience. The consumer must dilute the concentrated windshield washer fluid or dissolve the solid tablets using measured amounts of water using a separate container. Other varieties of windshield washer fluid distributed in concentrated or tablet form are meant to be mixed directly in the washer fluid tank of an automobile, leading to potential problems involving improper dilution such as clogging caused by undissolved particles. Furthermore, many windshield washer fluids sold in concentrated or tablet form do not contain anti-freeze, requiring consumers to add in the appropriate amount of anti-freeze separately, resulting in unexpected freezing of the windshield washer fluid caused by improper addition of the anti-freeze component.

A need therefore exists for a single container capable of transporting, mixing, and diluting a windshield washer fluid concentrate, and then dispensing the resultant windshield washer fluid, which address the transportation and storage costs of ready to use windshield washer fluid as well as the inconvenience and risk of improper dilution of windshield washer fluid in concentrated and tablet form.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a single container which allows a concentrated motor vehicle fluid to be diluted and dispensed. Accordingly, the present disclosure provides a fluid container having an outer wall, a fluid chamber within the outer wall adapted to hold the motor vehicle fluid, and an additive concentrate stored within the fluid chamber which is adapted to dissolve when mixed with water to form the motor vehicle fluid. The fluid container further has a selectively sealable opening which allows water to be poured into the fluid chamber where it can be mixed with the additive concentrate to form the motor vehicle fluid, which can then be dispensed through the opening.

It is another aspect of an example embodiment in the present disclosure to provide a container which allows a user to prepare motor vehicle fluid having a desired freezing point. Accordingly, the additive concentrate contains an anti-freeze component, and the fluid container has a calibrated dilution scale which allows the user to dilute the additive concentrate according to one or more dilution levels, and the freezing point of the resultant motor vehicle fluid is determined by the dilution level. The outer wall has a transparent portion which allows the user to view the fluid chamber and the motor vehicle fluid contained within, and the calibrated dilution scale has one or more dilution markers positioned over the transparent portion to allow the user to precisely dilute the motor vehicle fluid to the desired dilution level.

It is yet another aspect of an example embodiment in the present disclosure to provide a container which allows the motor vehicle fluid to be transported and stored at reduced space and weight when compared to ready to use motor vehicle fluids. Accordingly, the outer wall of the fluid container is flexible and is adapted to expand from a flattened state to an expanded state as water is added to the fluid chamber, allowing the motor vehicle fluid to be transported and stored efficiently in the flattened state, in contrast to a container filled with ready-to-use motor vehicle fluid.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
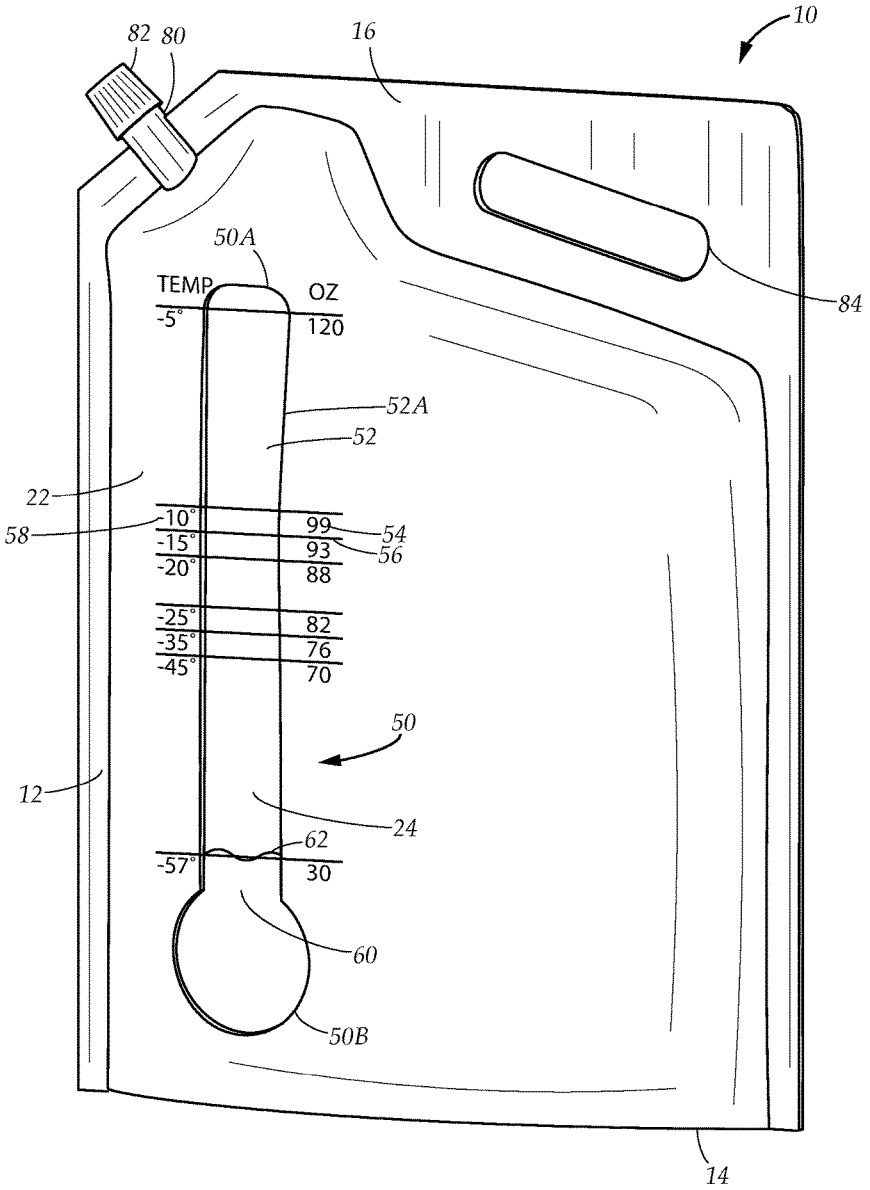
FIG. 1 is a diagrammatic perspective view of a fluid container, showing an outer wall of the fluid container and a calibrated dilution scale positioned over a transparent portion of the outer wall which provides visibility into the fluid chamber contained therein, in accordance with an embodiment in the present disclosure.

FIG. 1 illustrates a fluid container 10 for transporting, mixing, and dispensing a motor vehicle fluid 60. The motor vehicle fluid 60 is a liquid which is essential to the operation of a motor vehicle, such as an automobile, or the components thereof, such as engine coolant or windshield washer fluid. The motor vehicle fluid 60 is typically a liquid solution which has a freezing point lower than the freezing point of water in order to prevent the motor vehicle fluid 60 from freezing under cold weather conditions and damaging the components of the motor vehicle and/or rendering the motor vehicle inoperable.

The fluid container 10 comprises an outer wall 12, a container upper portion 16, and a container base 14. The outer wall 12 defines the shape of the fluid container 10 while the container base 14 supports the fluid container 10 in an upright position when the container base 14 is placed upon a horizontal surface. The outer wall 12 further has a first container face 22 disposed between the container upper portion 16 and the container base 14. The fluid container 10 further comprises a fluid chamber 24 disposed within the outer wall 12 which is adapted to hold the motor vehicle fluid 60, water, or other fluid. In order to allow the fluid chamber to be visible to a user, the outer wall 12 has a transparent portion 52 corresponding to part of the outer wall 12 or the entirety thereof. The surface of the motor vehicle fluid 60 or other fluid within the fluid chamber 24 corresponds to a fluid level 62 which is visible to the user through the transparent portion 52 of the outer wall 12. In a preferred embodiment, the transparent portion 52 may correspond to part of the first container face 22.

The fluid container 10 further has an opening 80 which allows the fluid container 10 to be filled with fluid, and also allows the motor vehicle fluid 60 to be poured out of the fluid container 10. The fluid container 10 further comprises a seal 82 which is adapted to selectively cover the opening 80, preventing the motor vehicle fluid 60 from exiting the fluid container 10 through the opening 80 unless the opening is uncovered.

Figure 5:
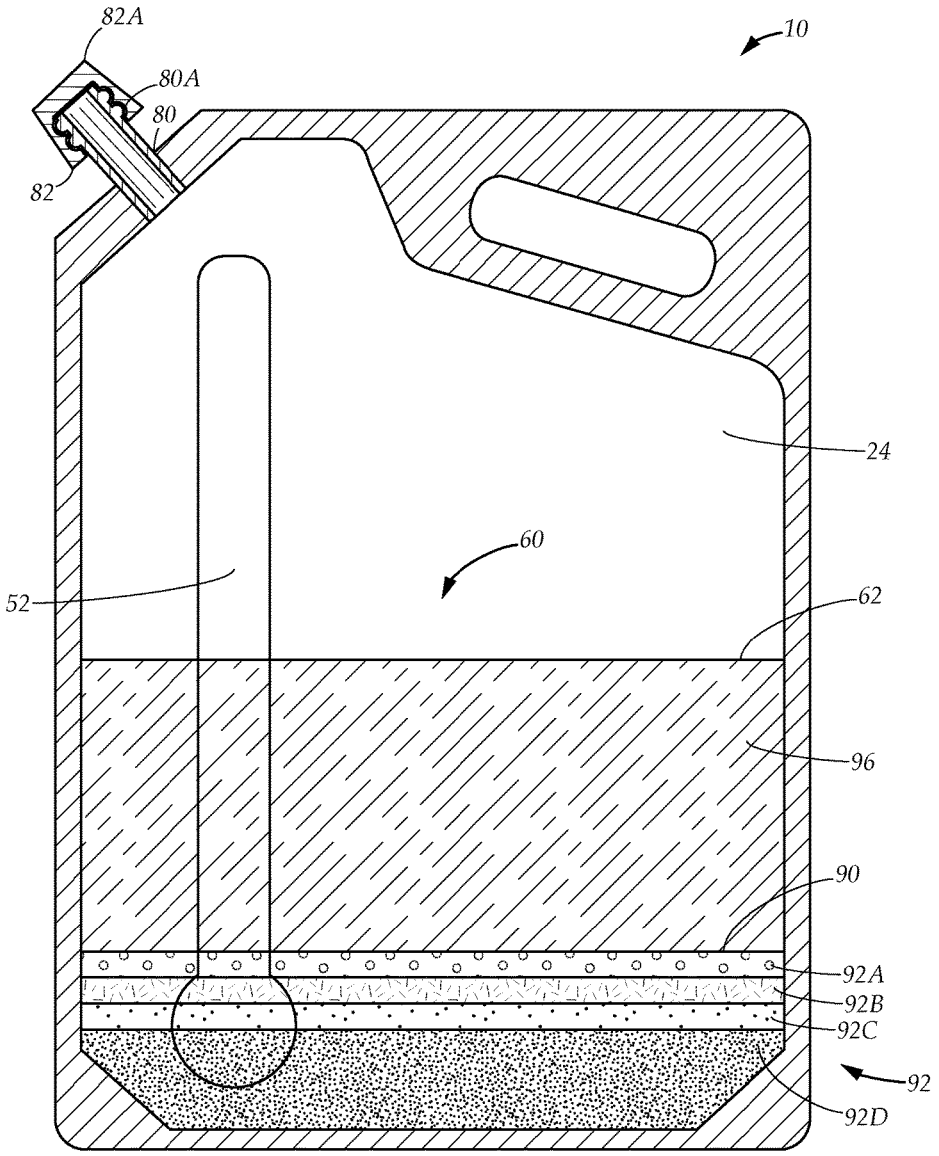
FIG. 5 is a cross section view of the fluid container showing the contents of the fluid chamber, which depicts the water and additive concentrate which mixes together to form the motor vehicle fluid, in accordance with an embodiment in the present disclosure.

Turning now to FIG. 5, while continuing to refer to FIG. 1, the fluid chamber 24 contains an additive concentrate 90, which when mixed with water 96, dissolves in the water to form the motor vehicle fluid 60. The additive concentrate 90 may further comprise one or more additives 92 which give the motor vehicle fluid 60 its functional properties. One of the additives 92 may be an anti-freeze component 92A which lowers the freezing point of the motor vehicle fluid 60 below the freezing point of water. The fluid container 10 may be provided to a user with the fluid chamber 24 containing the additive concentrate 90, allowing the user to fill the fluid container 10 with water 96 so that the additive concentrate 90 dissolves in the water, producing the motor vehicle fluid 60 in a ready to use state. As the water 96 contributes the majority of the total weight of the motor vehicle fluid 60, providing the fluid container 10 to the user with only the additive concentrate 90 contained within the fluid chamber 24 allows the fluid container 10 to be transported at a fraction of the weight of a conventional premixed motor vehicle fluid.

Returning to FIG. 1, while continuing to refer to FIG. 5, the fluid container 10 further comprises a calibrated dilution scale 50 which has a plurality of dilution markers 56 each corresponding to a dilution level. Each dilution level represents a specific ratio of the additive concentrate 90 and the water 96 constituting the motor vehicle fluid 60, and the freezing point of the motor vehicle fluid 60 is determined by the dilution level, particularly the ratio of the water 96 and the anti-freeze component 92A. Each dilution marker therefore also corresponds to a dilution marker temperature equal to the freezing point of the motor vehicle fluid 60 at the dilution level of the dilution marker, and a dilution marker volume which equals the total volume of the motor vehicle fluid 60 at said dilution level. The calibrated dilution scale 50 is therefore adapted to allow the user to measure the volume of water 96 which is mixed with the additive concentrate 90 in order to control the freezing point of the resultant motor vehicle fluid 60 produced within the fluid chamber 24. In general, increasing the amount of water 96 in relation to the additive concentrate 90 increases the dilution of the additive concentrate 90 and raises the freezing point of the motor vehicle fluid 60, while adding less water lowers the freezing point thereof.

In a preferred embodiment, the calibrated dilution scale 50 is disposed on the first container face 22, and the dilution markers 56 are positioned along the transparent portion at intervals between the container base 14 and the container upper portion 16. Each dilution marker 56 may have a corresponding dilution marker volume indicator 54 which is a number representing a particular volume of fluid, as expressed in units of volume such as ounces, liters, or other unit of measurement for volume. The user may measure the volume of the motor vehicle fluid 60 within the fluid chamber 24 by comparing the position of the fluid level 62 with the nearest dilution marker 56, as the fluid level 62 rises or falls within the fluid chamber 24. When the fluid level 62 aligns with one of the dilution markers 56, the volume of the motor vehicle fluid 60 within the fluid chamber 24 is equivalent to the volume as expressed by the dilution marker volume 54 of the dilution marker 56. In a preferred embodiment, the dilution markers 56 may be formed as horizontal lines arranged in parallel with each other.

In certain embodiments, the transparent portion 52 forms a transparent window 52A which is oriented vertically and extends between an area proximate to the container base 14 and an area proximate to the container upper portion 16, and the dilution markers 56 are positioned over the transparent window 52A.

The calibrated dilution scale 50 further has a plurality of dilution marker temperature indicators 58 expressed as units of temperature such as degrees of Fahrenheit or Celsius, and each dilution marker temperature indicator 58 allows the user to identify the dilution marker temperature of its associated dilution marker. Prior to adding water 96 to the fluid chamber 24, the user determines a freezing threshold. The freezing threshold may be a temperature which is lower than the coldest anticipated temperature which the user expects the motor vehicle will be subjected to. The dilution marker temperature 58 indicator allows the user to select the appropriate dilution marker 56 so that the freezing point of the motor vehicle fluid 60 will be equal to or below the freezing threshold. The user then adds water 96 to the fluid chamber 24 until the fluid level 62 aligns with the selected dilution marker 56.

Figure 2:
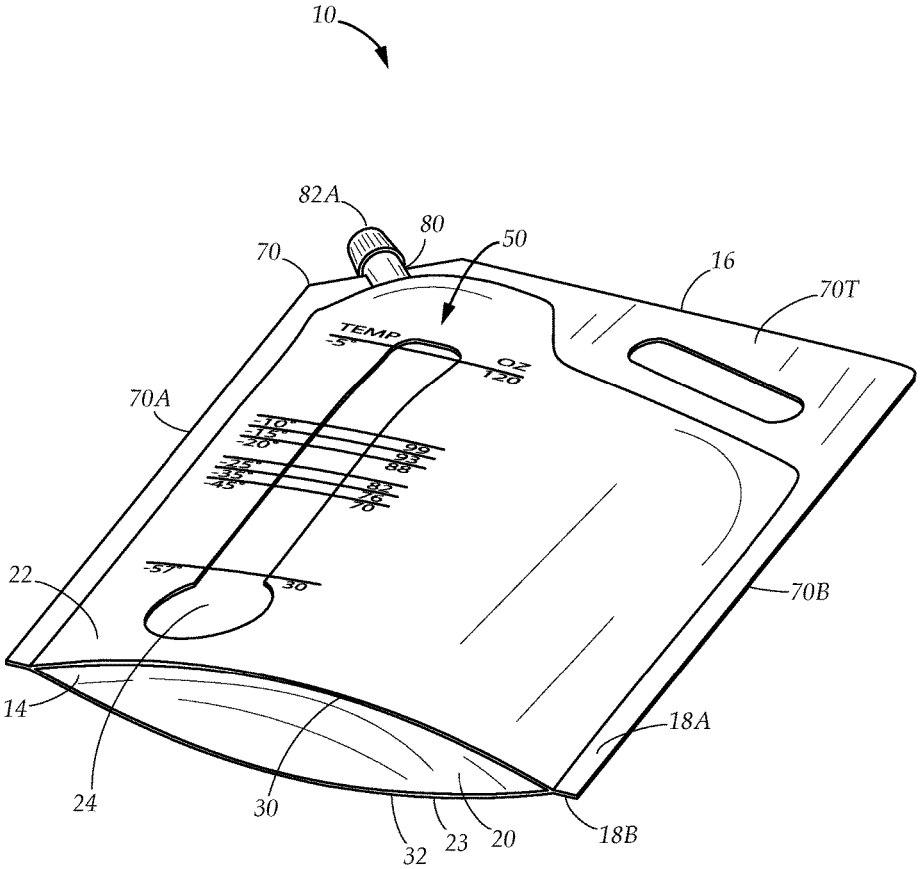
FIG. 2 is a diagrammatic perspective view of the fluid container seen from below, showing a container base, in accordance with an embodiment in the present disclosure.

Turning now to FIG. 2, while continuing to refer to FIGS. 1 and 5, the fluid container 10 may also be adapted to be expandable, allowing the fluid container to expand from a flattened state to a filled state as water 96 is added and the volume of the motor vehicle fluid 60 within the fluid chamber 24 increases. The outer wall 12 is formed from a material which is flexible but impermeable, such as plastic. In a preferred embodiment, the outer wall 12 may have a container edge 70, which in turn has a first vertical edge 70A and a second vertical edge 70B extending between the container base 14 and the container upper portion 16. The outer wall 22 of the fluid container 10 may have a first side wall 18A and a second side wall 18B disposed opposite to the first side wall 18A, each having an outer edge and an inner surface. The outer edges of the first and second side walls 18A, 18B may be joined to each other at the container edge 70 along the first and second vertical edges 70A, 70B. The container base 14 may be formed by a first supporting edge 30 disposed on the first side wall 18A, and a second supporting edge 32 disposed on the second side wall 18B. The outer wall 12 may further comprise a bottom wall 20 extending between the first and second supporting edges 30, 32. The fluid chamber 24 is defined by the inner surface of the first and second side walls 18A, 18B, and the bottom wall.

Prior to the addition of water 96 to the fluid chamber 24, the fluid container 10 may be placed in the flattened state whereby the first and second side walls 18A, 18B flatten towards each other and the bottom wall 20 folds inward towards the container upper portion 16. As water 96 or another fluid enters and fills the fluid chamber 24, the distance between the first and second side walls 18A, 18B increases and the bottom wall 20 unfolds, allowing the fluid chamber 24 to expand until it reaches its maximum capacity. This allows the fluid container 10 to be transported and stored in the flattened state to save space, in addition to weight. In a preferred embodiment, the fluid chamber 24 may have a maximum capacity of 1 gallon (32 ounces) but may further be adapted to have a larger or smaller maximum capacity. Note that the exemplary configuration of the outer wall 12 described above is non-limiting, and the outer wall 12 may be configured in a variety of shapes and arrangements in accordance with the principles of the present disclosure.

Figure 3:
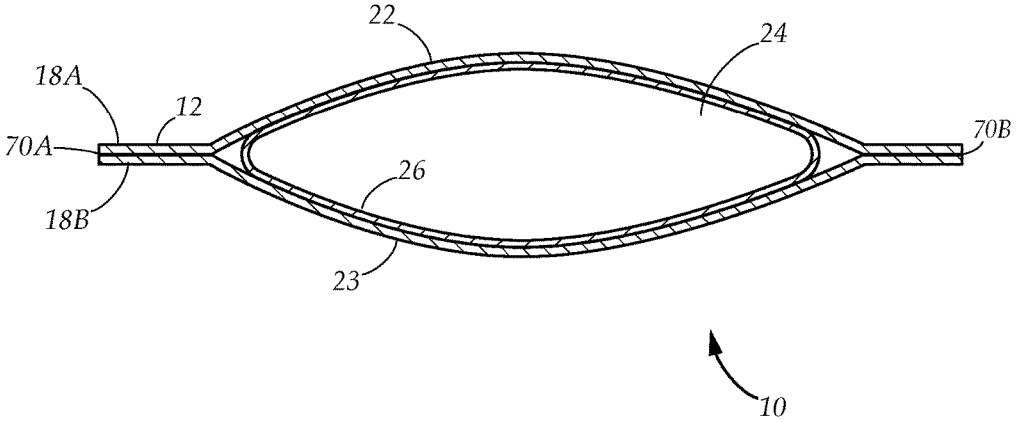
FIG. 3 is a cross-section of the fluid container, showing an inner lining positioned within the outer wall which serves as the fluid chamber, in accordance with an embodiment in the present disclosure.

Turning now to FIG. 3, while continuing to refer to FIGS. 1, 2, and 5, the fluid container 10 may, in certain embodiments, further comprise an inner lining 26 positioned within the outer wall 12. The inner lining 26 is configured as a flexible bag having an outer surface attached to the outer wall 12 and an inner surface which forms the fluid chamber 24. The inner lining 26 separates the motor vehicle fluid 60 from the outer wall 12 and may serve as an additional layer of protection in the event that the outer wall 12 is punctured, preventing the often toxic or corrosive additives within the additive concentrate 90 from leaking out of the fluid container 10. The inner lining 26 may also have corrosive-resistant properties, preventing the motor vehicle fluid 60 from contacting and damaging or deteriorating the outer wall 12. Furthermore, the outer wall 12 may have a second container face 23 disposed on the second side wall 18B opposite to the first container face 22, which may be used to display text or graphics such as branding and logos.

Figure 4:
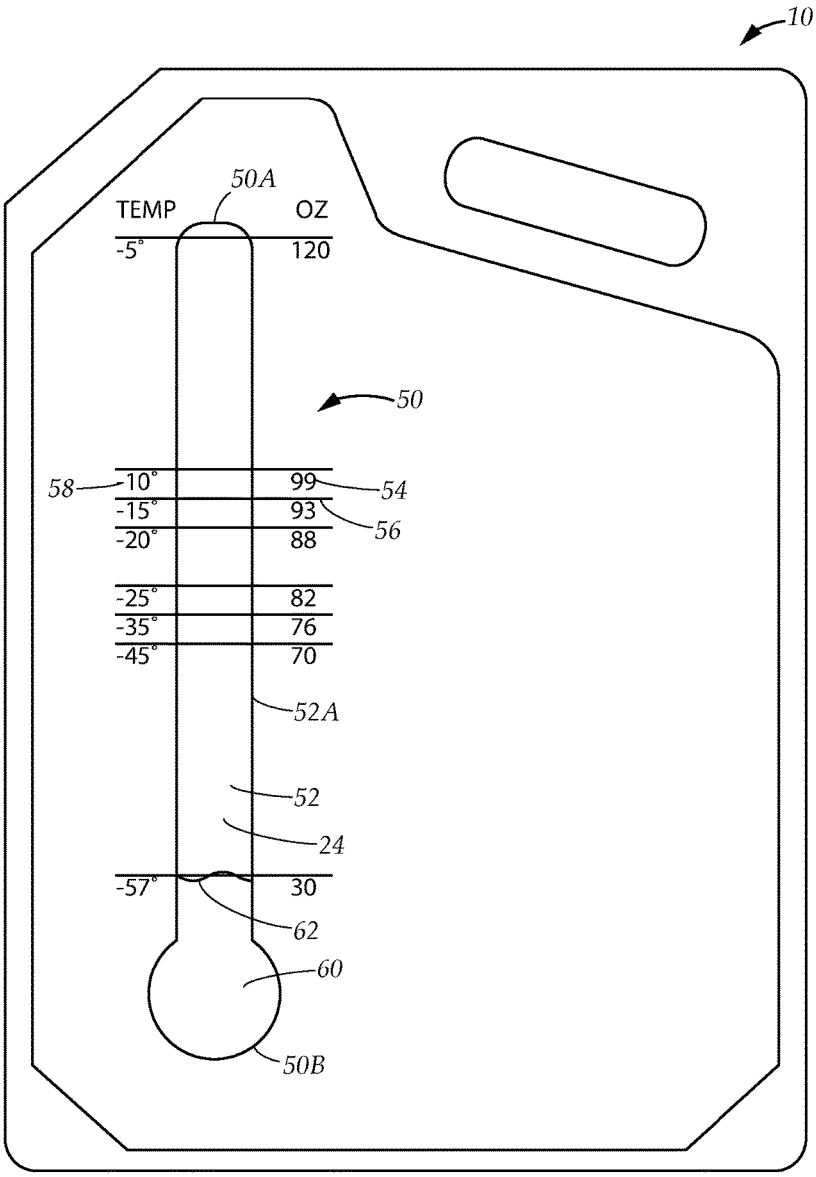
FIG. 4 is a plan view of the first side wall of the fluid container, showing the calibrated dilution scale and a plurality of dilution markers over the transparent portion, and the fluid level of the motor vehicle fluid contained within the fluid chamber, in accordance with an embodiment in the present disclosure.

Turning now to FIGS. 4 and 5, while continuing to refer to FIG. 1, the additive concentrate 90 may be composed of a liquid, powder, dissolving tablet, or other solution or mixture which allows the additives 92 to be dissolved in water 96 to create the motor vehicle fluid 60. The composition of the additive concentrate 90 depends on the function carried out by the motor vehicle fluid 60 within the motor vehicle. For example, FIG. 5 illustrates an exemplary composition of additive concentrate 90 comprising the anti-freeze component 92A, and a first, second, and third additive 92B, 92C, 92D. For example, where the motor vehicle fluid 60 is windshield washer fluid, the first, second, and third additives 92B, 92C, 92D may be a detergent, a water softener, an alcohol-based solvent, or any other component typically used in windshield washer fluid.

The dilution markers 56 of the calibrated dilution scale 50 are calibrated by taking into account the dimensions of the fluid container 10 and the characteristics of the motor vehicle fluid 60 and the additive concentrate 90, allowing the user to simply determine the desired freezing point which is equal to or below the freezing threshold, select the appropriate dilution marker 56, and fill the fluid chamber 24 with water 96 until the fluid level 62 aligns with the selected dilution marker 56. In a preferred embodiment, the container base 14 aids the alignment of the fluid level 62 with the dilution markers 56 by supporting the fluid container 10 such that it is upright and substantially perpendicular to the horizontal surface upon which the fluid container 10 is placed. The container base 14 also ensures that the dilution markers 56 are parallel with the horizontal surface and the fluid level 62, thus increasing the accuracy of the calibrated dilution scale 50.

Continuing to refer to FIGS. 4 and 5, in certain embodiments where the additive concentrate 90 dissolves completely in the water 96, the dilution marker volume indicator 54 associated with each dilution marker 56 may correspond to the volume of water 96 to be added. However, where the additive concentrate 90 is a liquid, the dilution marker volume indicator 54 may indicate the total combined volume of the water 96 and the additive concentrate 90. For example, based on the exemplary calibrated dilution scale 50 shown in FIG. 4, if the user wishes to prepare the motor vehicle fluid 60 where the freezing threshold is −10 degrees Fahrenheit, the user selects the dilution marker 56 corresponding to the dilution marker temperature indicator 58 of −10 degrees Fahrenheit, and adds water 96 to the fluid chamber 24 until the fluid level 62 aligns with the selected dilution marker 56. In the present example, the total volume of fluid within the fluid chamber 24, including water 96 and additive concentrate 90, equals approximately 99 ounces. In another example, If the user wishes to prepare the motor vehicle fluid 60 for use where the freezing threshold is −57 degrees Fahrenheit, the user selects the dilution marker 56 having the dilution marker temperature indicator of −57 degrees, and adds water 96 to the fluid chamber 24 until approximately 30 ounces of fluid are held therein and the fluid level 62 aligns with the selected dilution marker 56. The user may shake the fluid container 10 after adding the water 96 in order to ensure that the additive concentrate 90 fully dissolves in the water 96.

Once the motor vehicle fluid 60 is prepared, the fluid container 10 may be used to dispense the motor vehicle fluid 60 for use with the motor vehicle. As shown in FIG. 5, in a preferred embodiment, the opening 80 of the fluid container 10 may be formed as a spout 80A which allows the motor vehicle fluid 60 to be poured from the fluid chamber 24 and through the spout 80A. The seal 82 may be a cap 82A which is adapted to selectively cover the spout 80A. The opening 80 and the seal 82 may be implemented in other ways. Referring back to FIG. 2, in an alternate embodiment, the first side wall 18A and the second side wall 18B may be adapted to separate along the container upper portion 16 to form the opening, which may be selectively sealed by means of a sealing means such as a re-sealable zipper or other mechanism.

In certain embodiments, the fluid container 10 may also comprise a handle 84, as shown in FIG. 1, formed as an opening in the outer wall 12 proximate to the container upper portion 16 which allows the user to grasp the fluid container 10.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a motor vehicle fluid mixing and dispensing container. The disclosure is illustrated by example in the drawing figures, and throughout the written description. It should be understood that numerous variations are possible, while adhering to the inventive concept. Such variations are contemplated as being a part of the present disclosure.

What is claimed is:

1. A method for mixing and dispensing a motor vehicle fluid, the motor vehicle fluid facilitates the operation of a motor vehicle or its components and has a freezing point, the method comprising the steps of:

providing a fluid container comprising an outer wall, a fluid chamber formed within the outer wall, and a selectively sealable opening adapted to allow water to be poured into the fluid chamber and the motor vehicle fluid to be poured out of the fluid chamber, the outer wall has a transparent portion adapted to allow a user to view the fluid chamber as well as a fluid level corresponding to the surface of the water or motor vehicle fluid within the fluid chamber;

providing an additive concentrate which is contained within the fluid chamber, the additive concentrate is adapted to dissolve when mixed with water to form the motor vehicle fluid and comprises one or more additives, wherein one of the additives is an anti-freeze component;

providing a calibrated dilution scale positioned on the transparent portion of the outer wall, the calibrated dilution scale has a plurality of dilution markers, each dilution marker has an associated dilution marker temperature and a dilution marker volume, each dilution marker is calibrated according to a dilution level corresponding to the volume of the water added in relation to the additive concentrate, such that when the additive concentrate within the fluid chamber is mixed with water and the fluid level aligns with one of the dilution markers, the freezing point of the motor vehicle fluid matches the dilution marker temperature of said dilution marker;

determining a freezing threshold of the motor vehicle fluid;

selecting one of the dilution markers, whereby the dilution marker temperature of the selected dilution marker is equal to or lower than the freezing threshold;

adding water to the fluid chamber via the opening until the fluid level within the fluid chamber aligns with the selected dilution marker as seen by the user through the transparent portion;

dissolving the additive concentrate in the water within the fluid chamber to form the motor vehicle fluid, whereby the freezing point of the motor vehicle fluid is equal to or below the freezing threshold; and dispensing the motor vehicle fluid through the opening.

2. The method as described in claim 1, wherein:

the fluid container further comprises a container top portion and a container base disposed opposite to the container top portion, the container base is adapted to support the fluid container in an upright position when placed upon a horizontal surface;

the plurality of dilution markers are vertically arranged parallel lines; and the step of adding water to the fluid chamber is preceded by the step of placing the fluid container in the upright position so that the dilution markers are parallel with the horizontal surface.

3. The method as described in claim 2, wherein:

the outer wall is flexible, and the fluid container is adapted to expand from a flattened state to an expanded state as water is poured into the fluid chamber;

the step of determining the freezing threshold is preceded by the step of preparing the fluid container, whereby the user obtains the fluid container in the flattened state and unseals the opening; and the step of adding water to the fluid chamber further comprises the step of causing the fluid container to enter the expanded state.

4. The method as described in claim 3, wherein the motor vehicle fluid is an engine coolant.

5. The method as described in claim 3, wherein the motor vehicle fluid is a windshield washer fluid.

6. A fluid container for mixing and dispensing a motor vehicle fluid, the motor vehicle fluid facilitates the operation of a motor vehicle or its components and has a freezing point, the fluid container comprises:

an outer wall comprising a first container face and a fluid chamber formed within the outer wall, the fluid chamber is adapted to hold the motor vehicle fluid and further contains an additive concentrate, the additive concentrate is adapted to dissolve when mixed with water to form the motor vehicle fluid and comprises one or more additives, wherein one of the additives is an anti-freeze component;

a transparent portion disposed on the first container face which is adapted to allow a user to view the fluid chamber and a fluid level corresponding to the surface of the water or motor vehicle fluid within the fluid chamber;

an opening which is selectively sealable and is adapted to allow water to be poured into the fluid chamber, the opening further allows the motor vehicle fluid to be dispensed by exiting the fluid chamber through the opening; and a calibrated dilution scale positioned on the transparent portion of the outer wall, the calibrated dilution scale has a plurality of dilution markers, each dilution marker has an associated dilution marker temperature and a dilution marker volume, each dilution marker is calibrated according to a dilution level corresponding to the volume of the water added in relation to the additive concentrate, such that when the additive concentrate within the fluid chamber is mixed with water and the fluid level aligns with one of the dilution markers, the freezing point of the motor vehicle fluid matches the dilution marker temperature of said dilution marker.

7. The fluid container as described in claim 6, wherein the outer wall further comprises a first side wall and a second side wall each having an outer edge and an inner surface, the outer edge of the first side wall is joined to the outer edge of the second side wall to form a container edge, the fluid chamber is defined by the inner surface of first and second side walls, and the first container face is formed on the first side wall.

8. The fluid container as described in claim 7, wherein the first side wall and the second side wall are flexible, and the fluid container is adapted to expand from a flattened state to an expanded state, wherein the inner surface of the first side wall is proximate to the inner surface of the second side wall while the fluid container is in the flattened state, and the distance between the inner surface of the first and second side walls increases as the water enters the fluid chamber as the fluid container enters the expanded state.

9. The fluid container as described in claim 8, wherein the fluid container further comprises a container upper portion, and a distally oriented container base adapted to support the fluid container in an upright position when placed upon a horizontal surface, such that the dilution markers are parallel with the horizontal surface.

10. The fluid container as described in claim 9, wherein the first side wall has a first supporting edge, the second side wall has a second supporting edge, and the outer wall further has a bottom wall which extends between the first and second supporting edges, wherein the container base is formed by the first supporting edge and the second supporting edge, and wherein the bottom wall is flexible and is adapted to fold upwards towards the container upper portion when the outer wall is in the flatted state, and unfold as the outer wall enters the expanded state.

11. The fluid container as described in claim 10, wherein the fluid container further comprises an inner lining formed as a flexible bag adapted to hold water or the motor vehicle fluid, the inner lining is positioned between the inner surface of the first and second side walls and corresponds to the fluid chamber.

12. The fluid container as described in claim 11, wherein the opening is formed as a spout, and the fluid container further comprises a cap adapted to selectively seal the spout.

13. The fluid container as described in claim 12, wherein the transparent portion corresponds to a transparent window which is oriented vertically and extends between the container base and the container upper portion, and the dilution markers are formed as a plurality of parallel lines positioned over the transparent window.

14. The fluid container as described in claim 13, wherein the fluid container further comprises a handle formed as an opening extending through the outer wall proximate to the container upper portion.

15. The fluid container as described in claim 14, wherein the inner lining is resistant to corrosive chemicals.

* * * * *